United States Patent [19]

Komura et al.

[11] 4,017,169

[45] Apr. 12, 1977

[54] COPY PAPER TRANSPORTING UNIT FOR USE IN ELECTRO-PHOTOGRAPHIC COPYING APPARATUS

[75] Inventors: Masaru Komura; Kenichi Arai, both of Toyokawa, Japan

[73] Assignee: Minolta Camera Kabushiki Kaisha, Azuchi, Japan

[22] Filed: May 20, 1975

[21] Appl. No.: 579,288

[30] Foreign Application Priority Data

May 31, 1974 Japan ..... 49-63737[U]

[52] U.S. Cl. ..... 355/3 R; 271/258; 271/273

[51] Int. Cl.[2] ..... G03G 15/00

[58] Field of Search ..... 355/3 R, 3 TR, 3 CH; 271/164, 258, 273

[56] References Cited

UNITED STATES PATENTS

| | | | |
|---|---|---|---|
| 3,193,283 | 7/1965 | Smith | 271/258 |
| 3,332,328 | 7/1967 | Roth | 355/3 R |
| 3,411,771 | 11/1968 | Bahr et al. | 271/273 |
| 3,563,535 | 2/1971 | Vitu et al. | 271/164 X |
| 3,661,383 | 5/1972 | Morrison | 271/273 |

*Primary Examiner*—Fred L. Braun
*Attorney, Agent, or Firm*—Wolder & Gross

[57] ABSTRACT

A copy paper transporting unit is combined with a corona transfer station in a support member which is mounted for lateral withdrawal from the interior of an electrophotographic copying machine. The transporting unit is made in two sections which are separable once the support member is withdrawn from the machines to permit easy access in case of a paper jam. The transfer station has a corona-generating device held in an active position close to the photosensitive member from which it transfers toned images (or latent images) to a sheet of copy paper. The corona-generating device is movably supported on the support member so that prior to withdrawal it can be retracted from its active position to prevent damage to the photosensitive member by any jammed paper. The arrangement includes a lock member preventing withdrawal of the support member prior to retraction of the corona-generating device.

10 Claims, 3 Drawing Figures

COPY PAPER TRANSPORTING UNIT FOR USE IN ELECTRO-PHOTOGRAPHIC COPYING APPARATUS

BACKGROUND OF THE INVENTION

1. Field of the Invention

This invention relates to a copy paper transporting unit for use in an electrophotographic copying apparatus, and more particularly to a copy paper transporting unit in which in the event that jamming of a copy paper occurs in a paper transport passage near an image transfer station opposite a photosensitive member bearing the image, the jammed copy paper may be readily removed therefrom without damaging the photosensitive member.

2. Discussion of the Prior Art

While thin copy paper is, in general, convenient for carrying or storing, since the copy paper tends to be deflected by rollers or belts provided in the reproducing apparatus for transportation in the copy process, turn-up or tucking of an edge of the copy paper is frequently caused due to a friction force or a moisture-adsorbing condition of the copy paper, resulting in jamming of copy paper in the transport passages.

Hitherto, in the event of the jamming of a copy paper in the paper transport passages, the procedure for removing the jammed paper has been to open a side plate in the main frame, or to release a transport belt. One difficulty encountered with such a procedure is the failure of the jammed paper to be removed readily or completely. In particular, when a paper jam occurs in the image transfer station, there is much risk of impairing the transfer corona or the photosensitive member. Thus, there has been required means for removing jammed paper which is free from the drawback described.

SUMMARY OF THE INVENTION

In view of the foregoing discussion, it is an object of the present invention to provide a copy paper transport unit for use in a copying apparatus with a housing in which there are provided an image transfer device and a pair of rotary belts for transporting copy paper, which belts are disposed in opposing relation to each other to define a copy paper path, and the image transfer device and the rotary belt pair being mounted on a support member withdrawably arranged in the housing, and in a manner such that the former is retractable from a position adjacent the photosensitive member. The rotary belt pair may comprise upper and lower belts, the upper belt being movable between open and closed positions by pivoting about a shaft, or pin, provided in a portion of the support member which is close to the photosensitive member, the support member being withdrawn from the housing to the outside thereof only with the transfer device spaced apart from the photosensitive member, so that the upper rotary belt may be pivotally moved to its open position for easy removal of the jammed copy paper.

Description of an embodiment of the present invention will be given below with reference to the accompanying drawing.

DETAILED DESCRIPTION OF THE INVENTION

Figure 1:
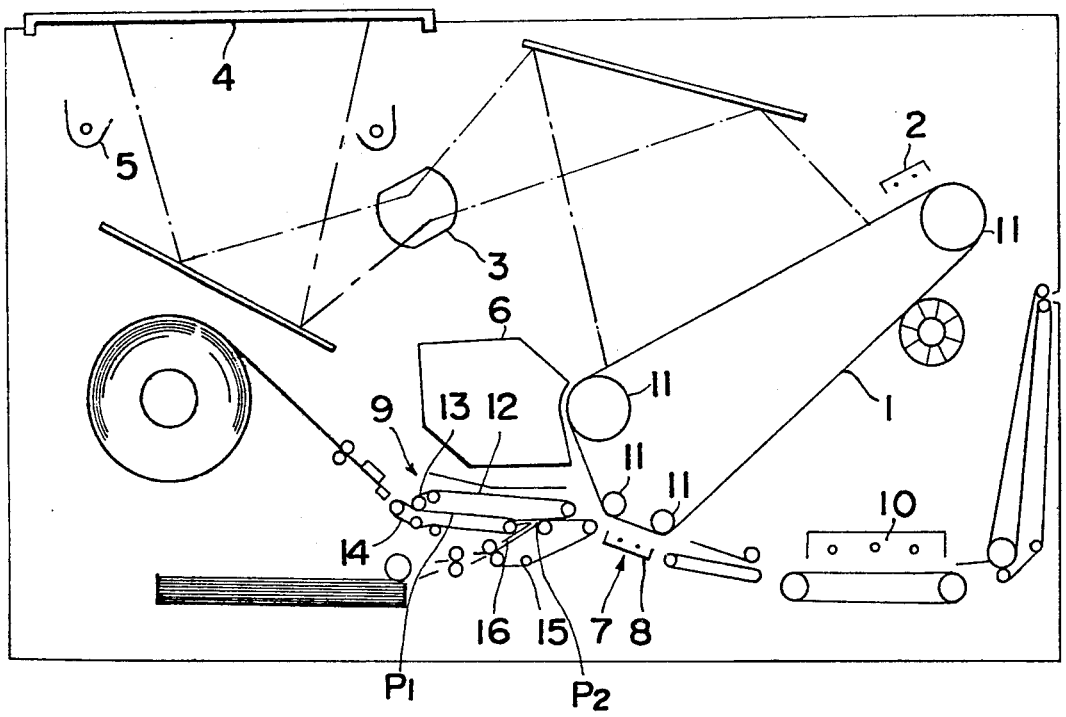
FIG. 1 illustrates the driving system of a reproducing apparatus in which the transport unit of the present invention is incorporated.

FIG. 1 illustrates a reproducing apparatus incorporating a copy paper transport unit according to an embodiment of the present invention. An image of an original document 4 exposed to light from illuminating lamps 5 is projected by way of an optical system 3 onto an area of a belt-like photosensitive member 1, supported on rollers 11, which has been uniformly electrostatically charged by means of a corona unit 2, the projection thereby forming an electrostatic latent image. The electrostatic latent image is developed into a powder image by means of a developing device 6, subsequently, through rotation of the belt-like sensitive member 1, the powder image reaches a transfer station 7 having an image transfer corona unit 8. In the meantime, a copy paper cut from a roll of reproducing paper or taken from a stack of precut sheets of the same type paper, is conveyed through the below-described copy paper transporting unit 9 in synchronism with rotation of the sensitive member to reach the transfer station 7 at the same time as the powder image bearing area on the sensitive member, so that the powder image will be electrostatically transferred to the copy paper, and is then ejected by way of a fusing station 10 to the outside of the apparatus.

The copy paper transporting unit 9 comprises an upper rotary belt 12, a first lower rotary belt 14 which 13 due to pressure of a roller 13 — is maintained in close contacting relation with a forward portion of the upper rotary belt 12 and in deflected condition, and a second lower rotary belt 15 also in contacting relation with belt 12, but disposed rearwardly of the first lower rotary belt 14. Transporting unit 9 accordingly forms a roll paper transporting path P1 defined between the upper rotary belt 12 and the first and second lower belts 14 and 15, and a cut paper transporting passage P2 defined between a guide plate 16 and a forward part of the second lower rotary belt 15, and between the rear portions of upper rotary belt 12 and the second lower rotary belt 15. The respective rotary belts 12, 14 and 15 are driven by any known means, and hence no description need be given.

Jamming of a copy paper may occur in the transporting parth P1 or P2 or at the image transfer station 7. If one attempts to remove the jammed copy paper from the side of the machine, there results the above-described risk, because the rotary belts 12, 14 and 15 constituting the respective transporting paths P1, P2 are maintained in close contacting relation to each other.

For this reason, according to the present invention, the transport section 9 and the image transfer charger 8 are mounted movably as an integral unit on a support member withdrawably mounted on the side plates of the main frame of the apparatus, so that the above-described drawbacks may be eliminated.

The copy paper transporting unit 9 will now be described in conjunction with FIGS. 2 and 3.

Shown at 18 is the support member mounted on the main frame T of the reproducing apparatus, member 18 being withdrawable therefrom to the outside along a pair of rails 19 and 19'. The above-mentioned first and second lower rotary belts 14 and 15 are mounted on support member 18. A frame member 20 provided with the upper rotary belt 12 closely contacting the lower rotary belts 14 and 15 is pivotally supported by a pin 21 secured to the support member 18. A pair of bell crank levers 22 are mounted on opposite sides of the front end of frame member 20 in a manner to be pivotally movable about a respective pin 23. Each bell crank lever 22 has one arm coupled through a link 25 to a lock lever 26 pivotally secured to a pin 27. A lock lever operation rod 24 is provided between the other arms of both crank levers 22, and thus, if rod 24 is pulled upwards toward the top in FIG. 2, then each lock lever 26 will be rotated in the counterclockwise direction, to be released thereby from engagement with an arresting member, which may be a pin 28 provided on support member 18.

Figure 3:
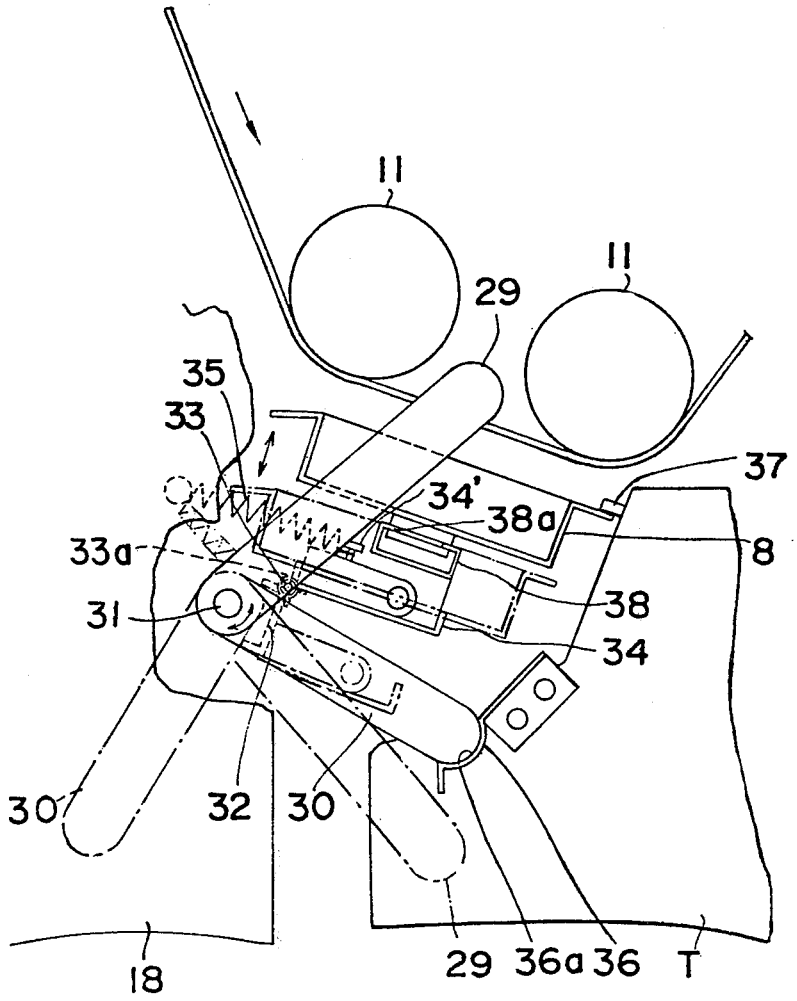
FIG. 3 is an enlarged view of a transfer station shown as part of FIG. 2.

An operating lever 29, mounted on a shaft 31 for rotation through 90° is located toward the rear of support member 18, and includes a detent arm 30 as shown in FIG. 3. Operating lever 29 and shaft 31 are rotatable together, relative to support member 18. A base plate 34 on which the transfer charger 8 is placed is secured by the medium of a hinge 33 on the upper edge of a bracket 32 rigid with shaft 31, in a manner such that bracket 32 is rotatable through 90° in the counterclockwise direction. The transfer charger 8 is inserted in a sliding fit relation in a rail member 38 by means of a member 38a having a cross section with a mating grooved shape, rail member 38 being rigidly secured to the top of base plate 34. The hinge 33 acts under the action of a spring for instance, a spring **33*a* mounted on the axis of hinge 33 in a manner such that transfer charger 8 is urged towards the belt-like sensitive member 1. In order to compensate for any weakness in the force of the above-mentioned spring, a tension spring 35 may be confined between the support member 18 and a pin 34' provided on the base plate 34.**

A detent 36 is provided on the main frame T of the apparatus. Formed of a spring material, the detent 36 serves for positioning the detent arm 30 in a manner such that when the transfer charger 8 assumes a normal rest position, as shown in solid lines in FIG. 3, the end of detent arm 30 engages in close-fitting relation with a mating portion **36*a* of detent 36, and also serves for preventing an unwanted shift of the image transfer charger 8, with a locking piece (not conveniently identical to arm 30, but not specifically shown in the figures because of the superposed relationship) engaging the main frame T. A stop 37 is provided on the main frame T and serves to hold transfer charger 8 in a normal rest position when base plate 34 is urged in the counterclockwise direction about the hinge 33 under the action of tension spring 35.**

During machine operation, jamming of a copy paper may occur in the transporting path P1 between the upper rotary belt 12 and the first and second lower rotary belts 14, 15, or in any portion of the copy paper transporting path P2 extending from a portion between guide plate 16 and the second lower rotary belt 15 and a portion between upper rotary belt 12 and the second lower rotary belt 15 to the transfer station. In such event, the operating lever 29 is first rotated 90° in the clockwise direction to disengage detent arm 30 from detent 36. The clockwise rotation of operating lever 29 through 90° causes hinge 33 to revolve clockwise with shaft 31. Base plate 34, being urged in the counterclockwise direction under the action of tension spring 35, as mentioned above, is therefore turned in the counterclockwise direction through 90° relative to hinge 33 (although the movement appears clockwise to the operator). As a result, transfer charger 8 is shifted substantially in parallel to a position spaced apart from the belt-like photosensitive member 1 (the shifted condition being shown by a one-dot chain line in FIG. 3).

With this shifted condition maintained, if support member 18, together with the upper rotary belt 12 and the first and second lower rotary belts 14, 15, is pulled outwardly by means of a force at right angles to the operating lever 29, then a copy paper jammed between the transfer charger 8 and the belt-like sensitive member 1 may be removed therefrom with ease, without damaging the surface of belt-like sensitive member 1.

Figure 2:
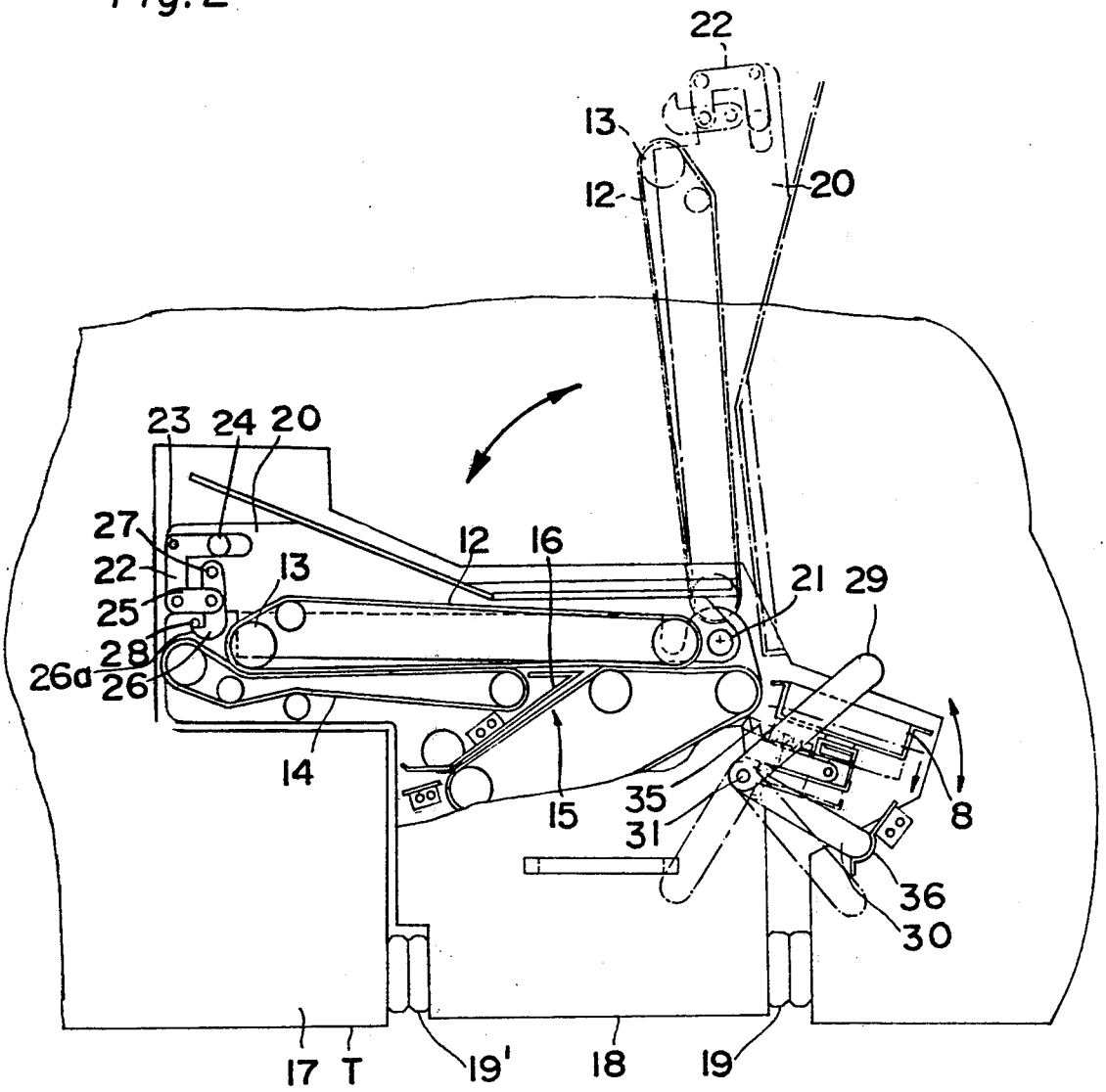
FIG. 2 is a side view of a copy paper transporting unit according to the present invention.

In the event that the jamming of the copy paper occured in the transporting path P1 or P2, the lock lever operation rod 24 is pulled upwards, whereby lock lever 26 will disengage from arresting pin 28, as described in the foregoing, and the frame member 20 will turn clockwise about the shaft 21 mounted on support member 18 to assume an open position as shown by a one-dot chain line in FIG. 2. Thus, copy paper jammed in the transporting path P1 or P2 will be removed therefrom with ease.

For resetting the reproducing paper transporting unit in the main frame T of the machine, the above-described procedures are reversed. During return of frame member 20 to a locked position in the support member 18, if the lock lever operation rod 24 is prematurely released from the operator's hand, frame member 20 will rotate in the counterclockwise direction due to the force of gravity, so that the free end of lock lever 26 will be brought into engagement with arresting pin 28, and thus frame member 20 will resume a locked position in support member 18. As mentioned previously, the respective rollers may be driven by a known method, and hence no description is given as to that.

As in apparent from the foregoing, according to the present invention the transporting unit constituting copy paper transporting passages is mounted on a support member 18 adapted to be withdrawn from the main frame of the apparatus in a manner to permit a pivotal movement towards an open position when withdrawn, the transfer charger 8 also being mounted thereon for shifting to a position spaced apart from the belt-like photosensitive member 1. This facilitates removal of a jammed copy paper without damaging the surface of photosensitive member 1, even if such jamming occurs in the vicinity of transfer station 7. Removal of a jammed copy paper is conducted on the outside of the reproducing apparatus, with resultant improved effectiveness.

If the construction adopted is such that withdrawal of the support members 18 from the main frame is effected only after ample separation of transfer charger 8 and photosensitive member 1, damage to that member will be completely avoided.

What is claimed is:

1. In an electrophotographic copying apparatus having a housing, a photosensitive member on which a latent charge image is formed corresponding to an original image to be copied, a transfer station located adjacent the photosensitive member, and a copy paper supply system including a transporting unit for presenting copy paper intermediate the imaged photosensitive member and the transfer station for transferring the image from the photosensitive member to the copy paper, the improvement comprising a support member within the housing adapted to be withdrawn therefrom, including locking means to prevent withdrawl of the support member from the housing, a transfer device movably mounted on said support member in a normal position of rest adjacent said photosensitive member, said normal rest position defining said transfer station, means mounting the transporting unit on the support member, the transporting unit comprising a pair of rotary elements cooperating to define a copy paper transport path having an entrance and an exit, said exit being adjacent the transfer station, manual means to move the transfer device to a retracted position well-spaced from the photosensitive member, and means operable to unlock said support member in response to moving the transfer device to the retracted position, thereby permitting withdrawl of the support member only when the transfer device is retracted,

2. An apparatus as defined in claim 1, wherein said normal rest position is determined by a stop affixed to said housing and further including a spring urging said transfer device against the stop.

3. An apparatus as defined in claim 2, wherein said manual means include a handle having a first position and displaceable to a second position, means moving said transfer device from the normal rest position to the retracted position in response to displacement of the handle from the first position to the second position, a locking member operable by the handle and engaging a portion of said housing with the handle in the first position and being disengaged therefrom with the handle in the second position, whereby said support member is locked within the housing or released for withdrawl therefrom according to the position of the handle.

4. An apparatus as defined in claim 3, wherein said displacement consists in rotating said handle through a predetermined angle and further including a detent spring, said handle being held in the first position by coaction with the detent spring.

5. An apparatus as defined in claim 1, wherein said pair of rotary elements comprises an upper endless belt and a lower endless belt and the upper endless belt is mounted in a separable frame member pivotably attached to the support member at a point near the exit of the transport path to permit raising the separable frame to provide access to the transport path.

6. An apparatus as defined in claim 5, wherein said normal rest position is determined by a stop affixed to said housing and further including a spring urging the transfer device against the stop.

7. An apparatus as defined in claim 5, further including at least two rollers journaled in the separable frame, said rollers generally defining a plane, and a third roller journaled in said frame at a location below said plane and being adapted to place the lower endless belt under tension when said raised separable frame is lowered to bring the belt pairs into path-defining relationship, and a lock singular form attached to the separable frame and engaging an arresting singular form in the support member to retain the belts in their tensioned, path-defining relationship.

8. An apparatus as defined in claim 7, wherein said manual means include a handle having a first position and displaceable to a second position, means moving said transfer device from the normal rest position to the retracted position in response to displacement of the handle from the first position to the second position, a locking member operable by the handle and engaging a portion of said housing with the handle in the first position and being disengaged therefrom with the handle in the second position, whereby said support member is locked within the housing or released for withdrawl therefrom according to the position of the handle.

9. An apparatus as defined in claim 8, wherein said displacement consists in rotating said handle through a predetermined angle, and further including a detent spring, said handle being held in the first position by coaction with the detent spring.

10. An apparatus as defined in claim 9, wherein said transfer device is a corona charge unit, said housing has side access panels, and the support member is mounted on a pair of slide rails for withdrawal from said housing via the side access panels.

* * * * *